United States Patent [19]

Cammarota

[11] 4,228,905

[45] Oct. 21, 1980

[54] STEMWARE SHELF BRACKET

[76] Inventor: David F. Cammarota, 59 Franklin St., Northport, N.Y. 11768

[21] Appl. No.: 964,495

[22] Filed: Nov. 29, 1978

[51] Int. Cl.[2] ..... A47F 7/00

[52] U.S. Cl. ..... 211/71; 108/28

[58] Field of Search ..... 211/71, 113, 162, 72; D6/188; D7/71; 108/28

[56] References Cited

U.S. PATENT DOCUMENTS

| | | | |
|---|---|---|---|
| 1,925,540 | 9/1933 | Neuschotz | D7/71 X |
| 2,230,975 | 2/1941 | Gratz | D7/71 X |
| 2,449,197 | 9/1948 | Benziger | 211/72 X |
| 2,580,961 | 1/1952 | Schmedinghoff | 211/113 |
| 2,753,054 | 7/1956 | Becher | D7/71 X |
| 3,022,899 | 2/1962 | Unsworth | 211/71 |
| 3,154,196 | 10/1964 | Loska et al. | D7/71 X |
| 3,214,031 | 10/1965 | McCauley | D7/71 X |
| 4,008,810 | 2/1977 | Merz | 211/71 |

*Primary Examiner*—Roy D. Frazier
*Assistant Examiner*—Robert W. Gibson, Jr.
*Attorney, Agent, or Firm*—Barnwell R. King

[57] ABSTRACT

A bracket having a flat rack is provided with upstanding front and rear flanges to which inwardly opening outwardly offset channels are connected. The bracket is slipped longitudinally on the underside of a removable shelf, so that the front and rear edge portions of the shelf are engaged thereby. Longitudinal openings for inverted stemware bases are provided in the front flange, with rearwardly extending slots for the stems thereof in communication with the centers of such openings. When such shelf is repositioned, the rack is located directly thereunder with the front and rear flanges offset inwardly of the front and rear edges of the shelf to insure stability of the bracket on the shelf. Thus, inverted stemware can be hung thereon by simply passing the bases through the opening and the stems into the corresponding slots.

1 Claim, 4 Drawing Figures

STEMWARE SHELF BRACKET

BACKGROUND OF THE INVENTION

The storing of inverted stemware is known, but only special racks that are custom built at great cost are available.

The main objects of this invention are to provide:

1. Inexpensive. convenient, decorative, high-density, safe, means for storing, drying and displaying delicate stemmed glasses.

2. A shelf bracket for stemmed glassware that can readily be assembled with a removable wall shelf by a simple, telescoping operation in which no damage to the shelf occurs.

BRIEF DESCRIPTION OF THE ILLUSTRATED EMBODIMENTS

A rectangular piece of flat material such as plastic or sheetmetal, is formed to provide a web having upstanding front and rear flanges to which are connected outwardly offset inwardly facing front and rear channels. Such channels are adapted to fit snugly the front and rear edge portions of a removable shelf when the shelf and channel are longitudinally telscoped by sliding the parts together. The resulting rack is located directly under but inwardly of the shelf when the latter is put back in use. In forming such material elongated openings are provided in the front flange, having slots extending rearwardly from the centers of the opening, whereby inverted stemware can be hung on the web under the shelf.

BRIEF DESCRIPTION OF THE DRAWINGS

Referring to the accompanying drawings

DETAILED DESCRIPTION OF THE DRAWINGS

Figure 1:
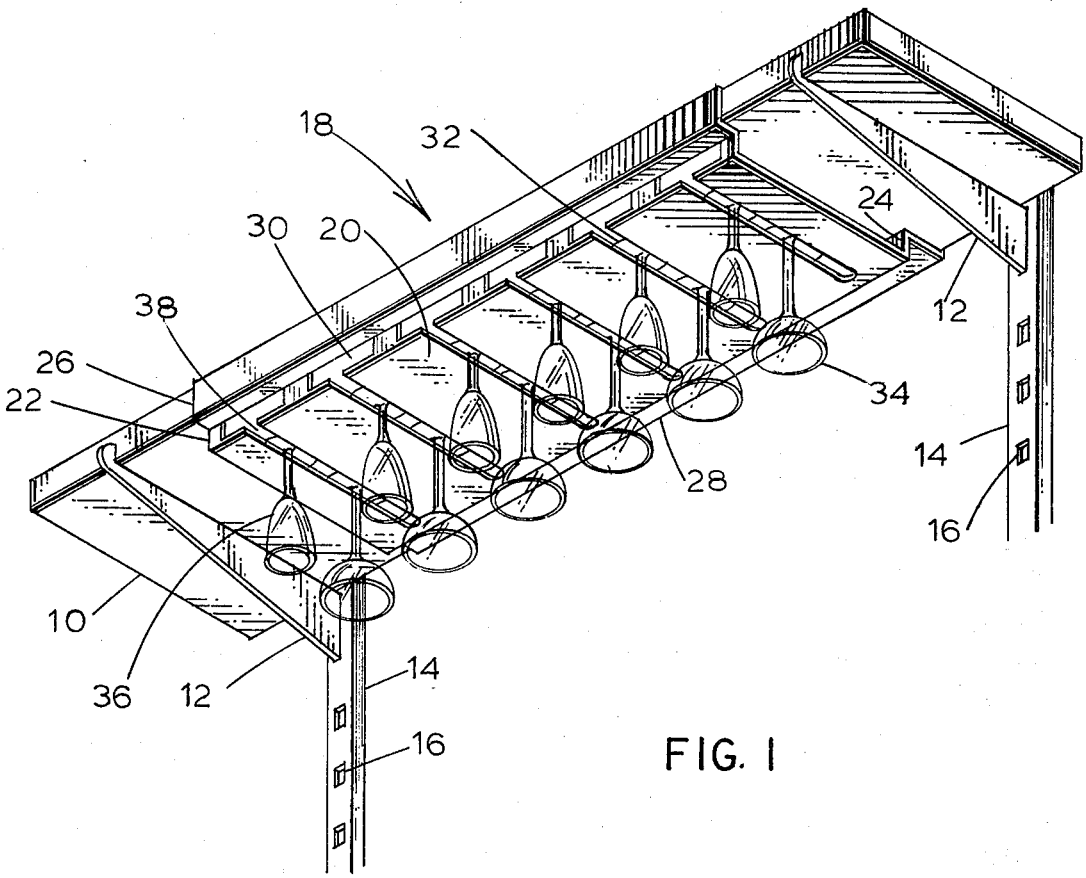
FIG. 1 is a fragmentary perspective view of a shelf bracket illustrative of the invention.
Figure 2:
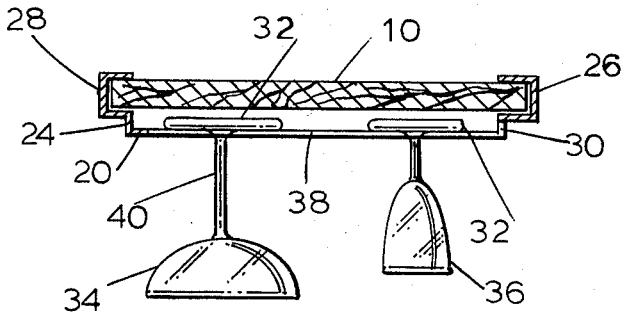
FIG. 2 is a view partly in section and partly in side elevation thereof.
Figure 3:
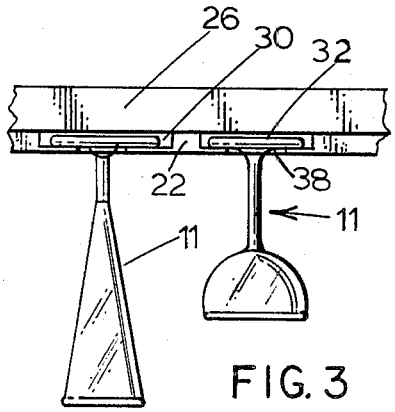
FIG. 3 is an enlarged fragmentary view in front elevation.

As shown in FIG. 1, 2, and 3, a shelf 10 is removably mounted on arms 12 projecting from vertical wall supports 14 having rectangular locking holes 16 for said arms 12. Mounted on said shelf 10 is a bracket 18 having web 20 provided with upstanding front and rear flanges 22 and 24 to which are connected inwardly opening outwardly offset channels 26 and 28. The channels 26 and 28 both enclose and grip the front and rear edge portions of the shelf 10. The shelf and bracket are assembled by first removing the shelf 10 from arms 12 and then sliding the parts longitudinally together. The assembly is then replaced on arms 12 with the rack or web 20 located directly under but inwardly offset from the front and rear edges of the shelf 10.

The front flange 22 contains spaced openings 30 for the passage of the base 32 of stemware 34, 36; while the web 20 is provided with slots 38 extending rearwardly from the centers of such openings, for passage of the stems 40 of such stemware. The stemware is thus hung from the rack 20 in inverted position.

Figure 4:
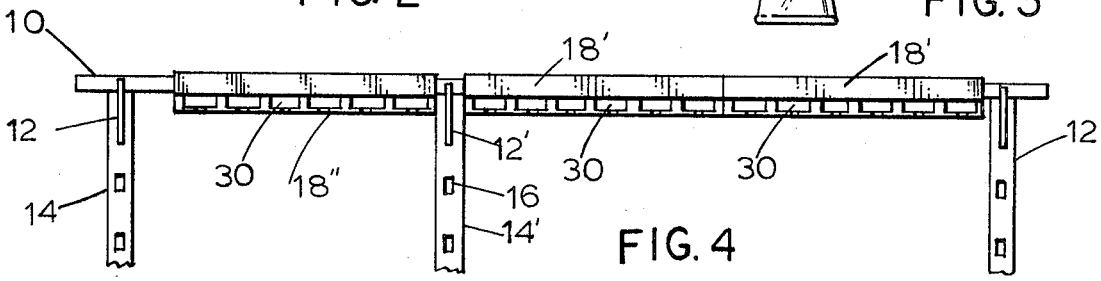
FIG. 4 is a view in front elevation of a modification involving spaced and adjoining racks on one shelf.

In FIG. 4 two racks 18', and 18, are arranged in adjointing relationship, while a third rack 18" is shown spaced therefrom, on the same shelf 10. In this case, an intermediate wall standard 14' is used for supporting rack 18" an arm 12', located between rack 18" and the racks 18, 18'.

ADVANTAGES OF THE INVENTION

The invention provides a decorative and advantageous means for storing delicate stemmed glasses. It can be attached to any removable shelf of the width for which the rack has been designed. Such shelves are commonly available in standard thicknesses and depths and may be found in many homes and places of business. Also in commercial places dealing with serving beverages to many people, such as restaurants, coctail lounges and catering establishments.

The rack provides a convenient place to safely store valuable stemware in high density, as well as a safe place to allow the stemmed glasses to dray after washing.

The invention also allows for the displaying of stemware while affording quick access thereto. Although the storing of stemware in inverted position is not new, there has not been an efficient and relatively inexpensive way to accomplish this task. It has been necessary to have special racks of various kinds custom built at great cost.

Along with such novel features of the invention is another. It has the ability of being able to be expanded into a modular installation which appears as one long shelf rack due to its ability to butt squarely against additional units of the invention in a continuous row. The invention also provides a stable way of holding stemmed glasses in a relatively fixed position in a moving vehicle or in a boat or an airplane. In addition, the invention can be easily installed without any tools or fasteners on a shelf or similar board, against a wall, overhead, in a display cabinet, in a closet, or elsewhere, and it can be built in various lengths to accommodate many or few glasses.

What is claimed:

1. A shelf bracket for hanging inverted stemware having a narrow stem connected to a wide base, comprising a flat horizontal rack having front and rear upstanding flanges connected to inwardly opening, elongated channels offset outwardly from said flanges and adapted to snugly fit the front and rear outer edge portions of a shelf on which the rack is mounted with said flanges depending from the lower inner edges of said channels in inwardly spaced relation to the front and rear edges of said shelf to insure stability of said bracket on the shelf, said front flange having a plurality of wide openings for the passage of an inverted stemware base, and a narrow slot extending rearwardly from the center of each such wide opening for the passage of the stem of said inverted stemware.

* * * * *